US006699005B2

(12) United States Patent
Askins

(10) Patent No.: US 6,699,005 B2
(45) Date of Patent: Mar. 2, 2004

(54) BOOKLET STACKING APPARATUS AND METHOD

(75) Inventor: Javier Pena Askins, Jalisco (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 81 days.

(21) Appl. No.: 10/099,745

(22) Filed: Mar. 15, 2002

(65) Prior Publication Data

US 2003/0175108 A1 Sep. 18, 2003

(51) Int. Cl.[7] ..... B65B 35/50

(52) U.S. Cl. ..... 414/788.3; 414/791.3; 414/794.8; 271/186; 270/58.08; 270/37

(58) Field of Search ..... 414/791.3, 788.3, 414/794.8; 271/186; 270/58.07, 58.03, 37

(56) References Cited

U.S. PATENT DOCUMENTS 4,307,800 A * 12/1981 Joa ..... 414/788.3 X
4,369,015 A * 1/1983 Fabrig ..... 414/788.3

* cited by examiner

*Primary Examiner*—Donald W. Underwood

(57) ABSTRACT

The present disclosure relates to a booklet stacking apparatus and method. More particularly, the present disclosure relates to a booklet stacking mechanism. In one arrangement, the booklet stacking mechanism comprises a gate that is adapted to be placed adjacent an output area, the gate being position able in a closed position and an open position, a delivery path along which booklets can be delivered when the gate is in the open position, and a flipping mechanism that is adapted to receive booklets, invert them, and deposit them in a output bin.

17 Claims, 8 Drawing Sheets

BOOKLET STACKING APPARATUS AND METHOD

FIELD OF THE INVENTION

The present disclosure relates to a booklet stacking apparatus and method. More particularly, the disclosure relates to a booklet stacking mechanism and method of its use with which printed booklets can be stacked in a vertically stacked arrangement.

BACKGROUND OF THE INVENTION

Many electrophotographic imaging devices such as printers can be equipped with booklet making apparatus that are configured for printing booklets, i.e., collections of various sheets of paper that are folded by the apparatus and then, typically, stapled along the fold line by the apparatus. Due to the particular media handling requirements for booklets, such booklets are often output by the booklet making apparatus to a stack-slide tray that is designed to receive booklets. With such a tray, the booklets are stacked in a linear, horizontal arrangement. An example of a stack-slide tray 100 is illustrated in FIG. 1.

As indicated in FIG. 1, the stack-slide tray 100 generally comprises an elongated tray 102 that extends horizontally outward from the booklet making apparatus 104, typically to a side of the apparatus. The stack-slide tray 100 typically further comprises a stop 106 that is used to prevent booklets 108 from falling off of the tray 102 as they are deposited thereon. As shown in FIG. 1, the stack-slide tray 100 is configured to receive booklets 108 with the stapled end 110 of the booklets facing away from the apparatus 104. More particularly, the stack-slide tray 100 is configured to begin in an initial retracted position (not shown) in which the stop 106 is positioned in relative close proximity to the booklet making apparatus 104, and gradually (typically incrementally) extend outwardly from the apparatus as booklets 108 are deposited in the tray 102. This gradual extension normally occurs in response to information sensed by a sensing arm 112, which senses the presence of booklets 108 in close proximity to the booklet making apparatus 104.

Operating in the manner described above, the stack-slide tray 100 functions to arrange the booklets 108 in a sequential, layered orientation such as that indicated in FIG. 1. As is evident from FIG. 1, booklets 108 are deposited in the stack-slide tray 100 until the height of the booklets activates the sensing arm 112 so as to cause the tray to extend away from the booklet making apparatus 104. As can be appreciated from FIG. 1, the partially overlapping manner in which the booklets 108 are deposited on the tray 102 is necessary in that the portion of the booklets 108 adjacent the stapled sides 110 is thicker, due to a pillowing effect, than the opposite sides of the booklets. Accordingly, if the partially overlapping orientation were not used, the booklets 108 would be unbalanced and would eventually topple off of the tray 102. As can further be appreciated from FIG. 1, however, the stack quality of the booklets 108 can be poor when a conventional stack-slide tray 100 is used. In particular, the booklets 108 can be deposited in disarray. If the fill level of a stack-slide tray 100 is not closely monitored, booklets 108 can fall to the floor, particularly where the stack-slide tray 102 is used to receive other (i.e., non-booklet) media. Accordingly, stack-slide trays such as that shown in FIG. 1 typically do not work well in multi-use environments.

Even where the booklets 108 do not fall from the slide-stack tray 100, the booklets can be deposited such a random order that it is difficult to determine the printing order. Although not a problem where each booklet is identical, disorder of the booklets can be disadvantageous where different booklets are printed (e.g., in separate printing jobs) in that the booklets then must be manually re-ordered by a human being. Finally, another disadvantage of stack-slide trays is the relatively large amount of space that is required for full extension of the tray.

From the foregoing, it can be appreciated that it would be desirable to have an apparatus and method for stacking booklets that avoids one or more of the aforementioned problems associated with conventional booklet stacking arrangements.

SUMMARY OF THE INVENTION

The present disclosure relates to a booklet stacking apparatus and method. More particularly, the present disclosure relates to a booklet stacking mechanism. In one arrangement, the booklet stacking mechanism comprises a gate that is adapted to be placed adjacent an output area of a booklet making apparatus, the gate being positionable in a closed position and an open position, a delivery path along which booklets can be delivered when the gate is in the open position, and a flipping mechanism that is adapted to receive booklets, invert them, and deposit them in an output bin.

The present disclosure also relates to a method for stacking booklets. In one arrangement, the method comprises the steps of permitting a booklet to be deposited in a vertical stacker bin, preventing another booklet from being deposited in the vertical stacker bin and instead delivering the other booklet to a flipping mechanism with which the booklet is inverted, and delivering the other booklet to the vertical stacker bin in the inverted orientation such that the booklets are arranged in a staggered configuration within the vertical stacker bin.

Additionally, the present disclosure relates to a printing device. In one arrangement, the printing device comprises means for attracting toner to a surface of a print medium, a booklet making apparatus, a vertical stacker bin, and a booklet stacking mechanism that comprises a gate positioned adjacent an output area of the booklet making apparatus, the gate being positionable in a closed position and an open position, and a flipping mechanism that is adapted to receive booklets, invert them, and deposit them in the vertical stacker bin.

The features and advantages of the invention will become apparent upon reading the following specification, when taken in conjunction with the accompanying drawings.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

Figure 1:
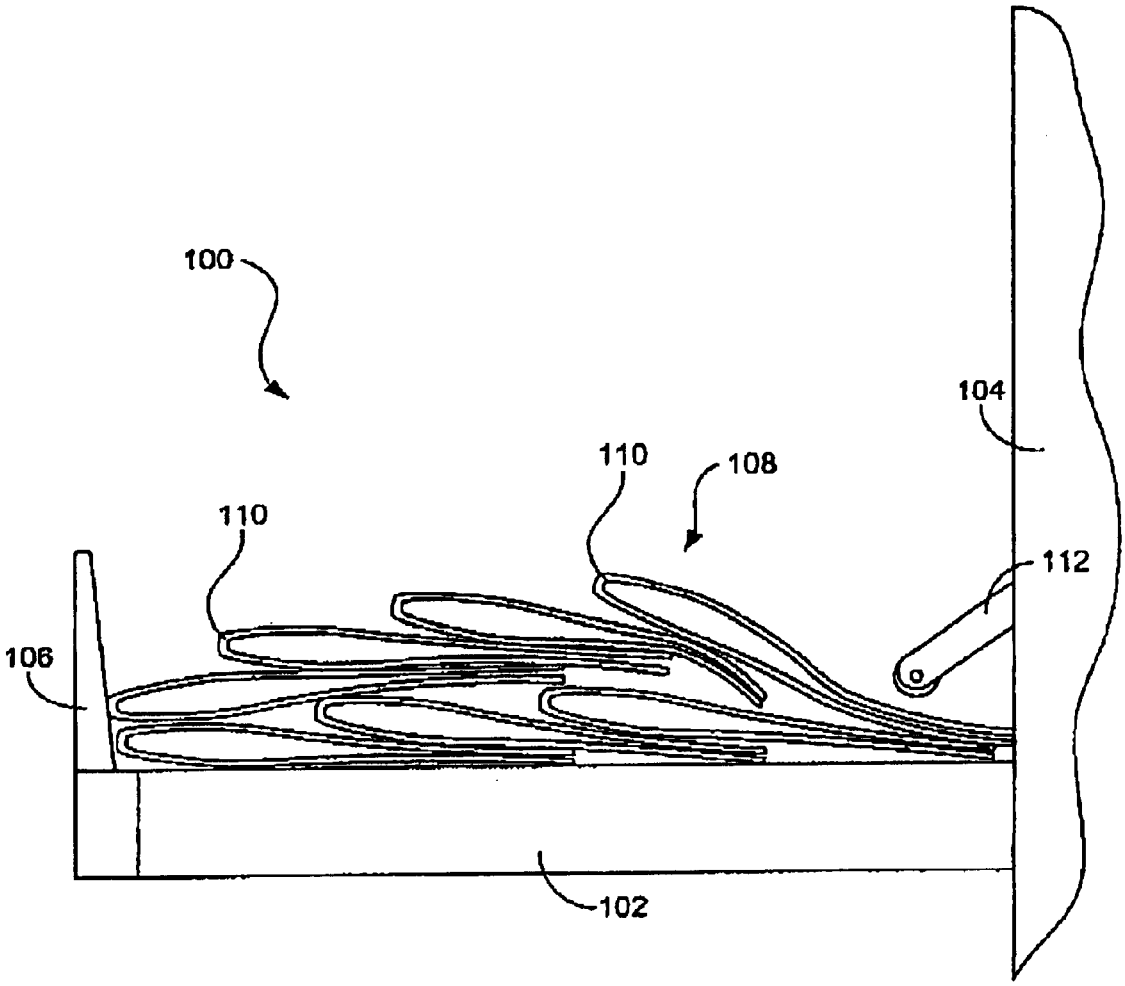
FIG. 1 (PRIOR ART)
FIG. 1 is a schematic view of a stack-slide tray of the prior art.
Figure 2:
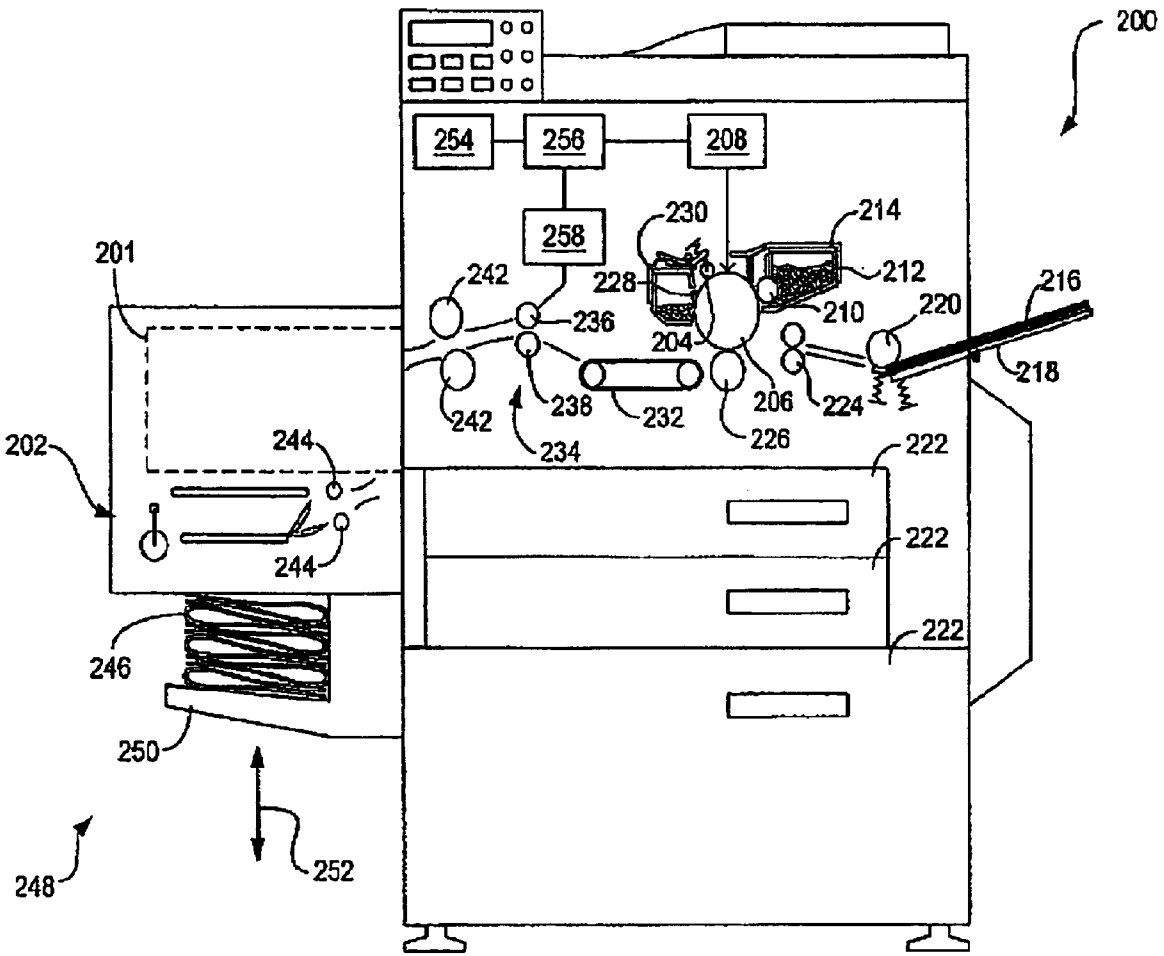
FIG. 2 is a schematic view of an electrophotographic imaging device having a booklet stacking mechanism.

Referring now in more detail to the drawings, in which like numerals indicate corresponding parts throughout the several views, FIG. 2 illustrates a schematic side view of a printing device 200 that incorporates a booklet making apparatus 201 and a booklet stacking mechanism 202, which is described in detail below. By way of example, the printing device 200 comprises a laser printer. It is to be understood, however, that the device 200 can, alternatively, comprise any other imaging device that produces or otherwise handles booklets including, for instance, a photocopier.

In the example of FIG. 2, the printing device 200 is arranged as an electrophotographic imaging device that includes a charge roller 204 that is used to charge the surface of a photoconductor drum 206 to a predetermined voltage. A laser diode (not shown) is provided within a laser scanner 208 that emits a laser beam which is pulsed on and off as it is swept across the surface of the photoconductor drum 206 to selectively discharge the surface of the photoconductor drum. In the orientation shown in FIG. 2, the photoconductor drum 206 rotates in the clockwise direction. A developing roller 210 is used to develop a latent electrostatic image residing on the surface of photoconductor drum 206 after the surface voltage of the photoconductor drum has been selectively discharged. Toner 212 is stored in a toner reservoir 214 of an electrophotographic print cartridge. The developing roller 210 includes an internal magnet (not shown) that magnetically attracts the toner 212 from the toner reservoir 214 to the surface of the developing roller. As the developing roller 210 rotates (counterclockwise in FIG. 2), the toner 212 is attracted to the surface of the developing roller 210 and is then transferred across the gap between the surface of the photoconductor drum 206 and the surface of the developing roller to develop the latent electrostatic image.

Print media 216, for instance sheets of paper, are loaded from an input tray 218 by a pickup roller 220 into a conveyance path of the device 200. Alternatively, the print media 216 can be placed into the conveyance path from an internal bin 222 of the device 200. Each recording medium 216 is individually drawn through the device 200 along the conveyance path by drive rollers 224 such that the leading edge of each print medium is synchronized with the rotation of the region on the surface of the photoconductor drum 206 that comprises the latent electrostatic image. As the photoconductor drum 206 rotates, the toner adhered to the discharged areas of the drum contacts the print medium 216, which has been charged by a transfer roller 226, such that the medium attracts the toner particles away from the surface of the photoconductor drum and onto the surface of the medium. Typically, the transfer of toner particles from the surface of the photoconductor drum 206 to the surface of the print medium 216 is not completely efficient. Therefore, some toner particles may remain on the surface of the photoconductor drum. As the photoconductor drum 206 continues to rotate, the toner particles that remain adhered to the drum's surface are removed by a cleaning blade 228 and deposited in a toner waste hopper 230.

As the print medium 216 moves along the conveyance path past the photoconductor drum 206, a conveyer 232 delivers the medium to a fusing system 234. The print medium 216 passes between a fuser roller 236 and a pressure roller 238 of the fusing system 202. As the pressure roller 238 rotates, the fuser roller 236 is rotated and the print medium 216 is pulled between the rollers. The heat applied to the print medium 216 by the fusing system 234 fuses the toner to the surface of the print medium.

Where the print media 216 are to be combined to form a booklet, the collected print media (typically two or more pieces of paper) are delivered to the booklet making apparatus 201 by output rollers 242. The booklet making apparatus 201 folds and, if desired, staples the media together to form booklets, which ultimately are deposited in a vertical stacker bin 248 that, by way of example, comprises a conventional output tray 250 which can be vertically displaced (as indicated by the double-sided arrow 252) depending upon the fill level of the bin.

As is further identified in FIG. 2, the printing device 200 can also include a formatter 254 and a controller 256. The formatter 254 receives print data, such as a display list, vector graphics, or raster print data, from a print driver operating in conjunction with an application program of a separate host computing device. The formatter 254 converts the print data into a stream of binary print data and sends it to the controller 256. In addition, the formatter 254 and the controller 256 exchange data necessary for controlling the electrophotographic imaging process. In particular, the controller 256 supplies the stream of binary print data to the laser scanner 208. The binary print data stream sent to the laser diode within the laser scanner 208 pulses the laser diode to create the latent electrostatic image on the photoconductor drum 206.

In addition to providing the binary print data stream to the laser scanner 208, the controller 256 controls a high voltage power supply (not shown) that supplies voltages and currents to the components used in the device 200 including the charge roller 204, the developing roller 210, and the transfer roller 226. The controller 256 further controls a drive motor (not shown) that drives the printer gear train (not shown) as well as the various clutches and feed rollers (not shown) necessary to move print media 216 through the conveyance path of the device 200 and, as is discussed below, operate the booklet stacking mechanism 202. A power control circuit 258 controls the application of power to the fusing system 234. Normally, the power control circuit 258 is configured such that the power to the fusing system 234 is linearly controlled and the power levels can be smoothly ramped up and down as needed.

As identified above, conventional booklet stacking methods, such as those implementing a stack-slide tray, can be disadvantageous. Accordingly, improved booklet stacking apparatuses and methods will be described. As identified above, the printing device 200 includes a booklet stacking mechanism 202 that is shown in greater detail in FIG. 3. As indicated in this figure, the booklet stacking mechanism 202 is normally positioned in close proximity to output rollers 244 located downstream from the booklet making apparatus 201. The booklet stacking mechanism 202 generally comprises a gate 300, a delivery path 302, and a flipping mechanism 304. The gate 300 is generally elongated (extending in a direction into the page) and is positioned at an opening 306 of the delivery path 302. Typically, the gate 300 is mounted to a shaft 308 that is driven by a drive mechanism (not shown) such that the gate can be pivoted about the shaft from a closed position (identified in FIG. 3) in which print media exiting the electrophotographic imaging device 200 may pass to the stacker bin, to an open position (identified in dashed lines) in which booklets can be directed into the delivery path 302. To ensure that the various print media are directed into the stacker bin when the gate 300 is in the closed position, the gate typically is constructed of a rigid material and may further have an curved outer surface.

The delivery path 302 is configured for efficient delivery of the booklets from the opening 306 of the path to the flipping mechanism 304. Accordingly, the delivery path 302 is sized and configured such that each booklet has enough momentum (provided by the output rollers 244) to reach the flipping mechanism 304. Alternatively, the delivery path 302 can be sized and configured such that each booklet reaches the flipping mechanism 304 while still being driven by the output rollers 244. In yet another alternative, the delivery path 302 can comprise its own conveyance means, such as a conveyor and/or one or more rollers, which ensure that the booklets reach the flipping mechanism 304. In any case, the delivery path 302 can be defined by upper and lower members 310 and 312. Additionally, the delivery path 302 can be laterally defined with side walls (not shown), if desired. Preferably, the inner surfaces of at least the lower member 312 are smooth to reduce friction created between the delivery path 302 and the booklets that pass along it.

Figure 3:
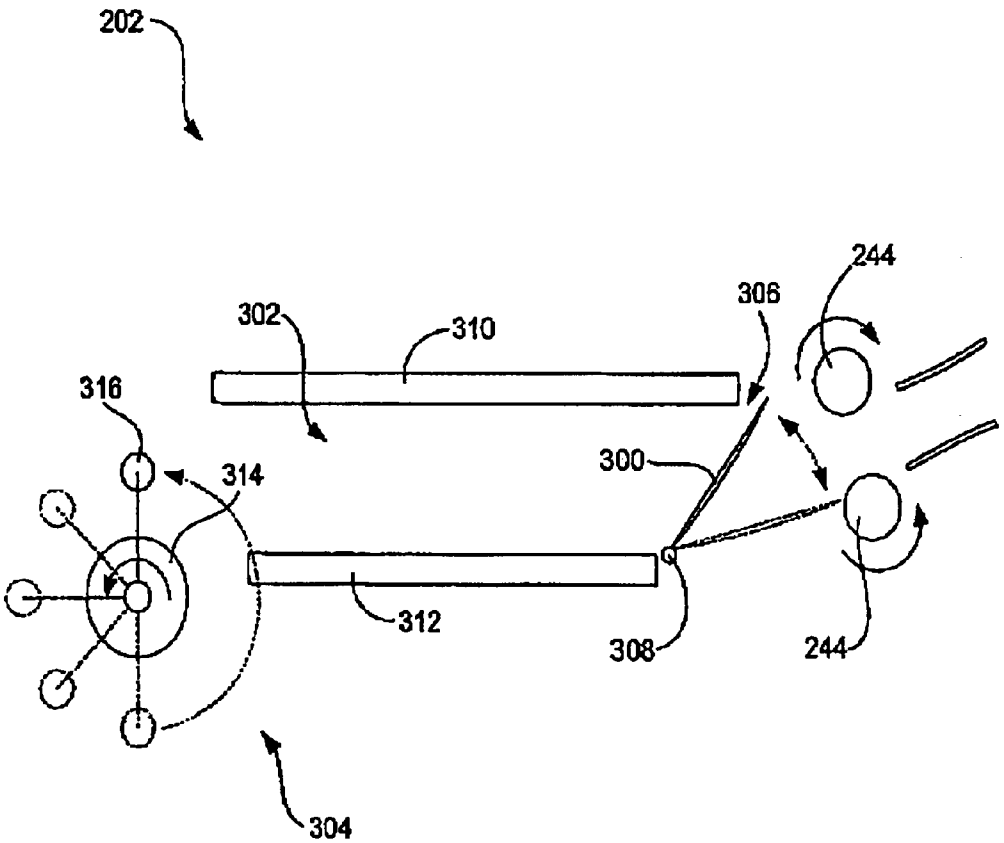
FIG. 3 is a schematic of the booklet stacking mechanism shown in FIG. 2.
Figure 4:
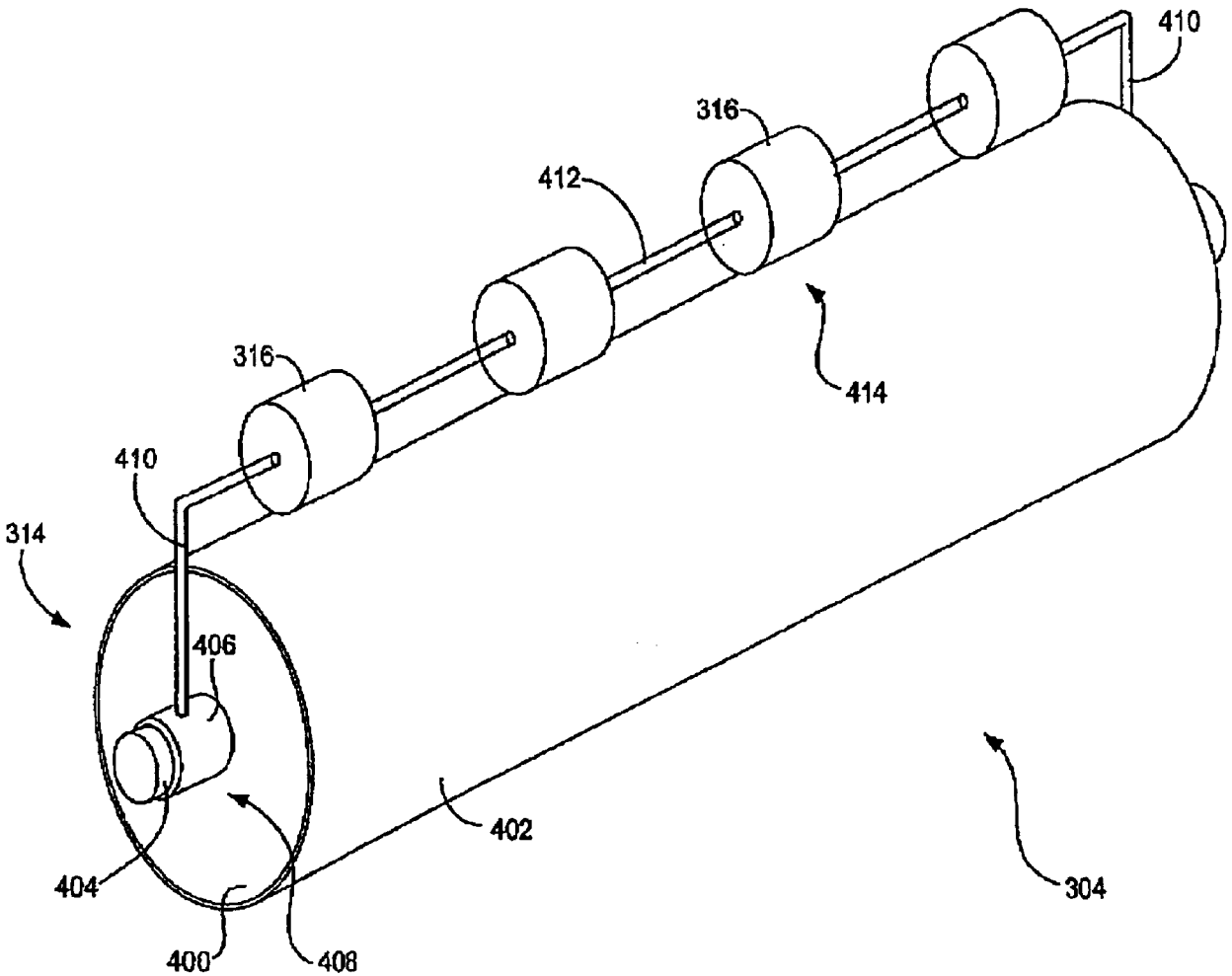
FIG. 4 is perspective view of a flipping mechanism of the booklet stacking mechanism shown in FIG. 3.

The flipping mechanism 304 is configured to invert booklets (e.g., every other booklet output from the booklet making apparatus 201) when multiple booklets are printed such that the booklets can be stacked in an alternating manner in the stacker bin, such as that depicted in FIG. 2. As is indicated in FIG. 3, the flipping mechanism 304 generally comprises a main roller 314 and one or more pressure rollers 316. An example configuration for the flipping mechanism 304 is provided in greater detail in FIG. 4. As shown in that figure, the main roller 314 is typically formed as an elongated cylinder 400 that is composed of a rigid material such as a metal (solid or hollow). Normally, the main roller 314 includes a resilient coating 402 made of an elastomeric material, e.g. rubber, which is disposed about the outer surfaces of the cylinder 400 to better grip booklets. The main roller 314 is fixedly mounted to a drive shaft 404 that is used to drive the flipper roller 304. Disposed about the drive shaft 404 are collars 406 (only one visible in FIG. 4) that form part of a clutch mechanism 408 used to intermittently rotate the pressure rollers 316 in unison with the main roller 314 such that the pressure rollers revolve about a central longitudinal axis of the main roller (see FIG. 3). The clutch mechanism 408 can comprise an internal electromagnetic clutch (not shown) that engages or disengages when power is delivered to the mechanism such that the collars 406 will rotate with the shaft 404 or remain fixed in position, as desired.

Attached to the collars 406 are link members 410 that extend in a direction radially outward from the drive shaft 404. These link members 410 are connected to a support beam 412 on which the one or more pressure rollers 316 are mounted. The pressure rollers 316 are normally rotatably mounted to the support beam 412 such that the pressure rollers can rotate freely (i.e., idle) about the support beam. Typically, the pressure rollers 316 are composed of an elastomeric material, such as rubber, to better grip booklets that arrive in a nip 414 that is formed between the pressure rollers and the outer surface of the main roller 314.

With reference back to FIG. 3, the main roller 314 is adapted to rotate in the counterclockwise direction (in the orientation shown in FIG. 3). In addition, the pressure rollers 316 are adapted to, when the clutch mechanism 408 is engaged, rotate in unison with (i.e., orbit) the main roller 312 when a booklet arrives in the nip 414 of the flipping mechanism 304 so that the booklet can be inverted, as is discussed below in greater detail. By way of example, the clutch mechanism 408 can be engaged to begin to rotate the pressure rollers 316 from an approximate twelve o'clock position down (FIG. 3) to an approximate six o'clock position (indicated in phantom). At this point, the clutch mechanism 408 can be disengaged to allow a booklet to be deposited in the stacker bin, and then be re-engaged to return the pressure rollers 316 back to the initial approximate twelve o'clock position.

Figure 5:
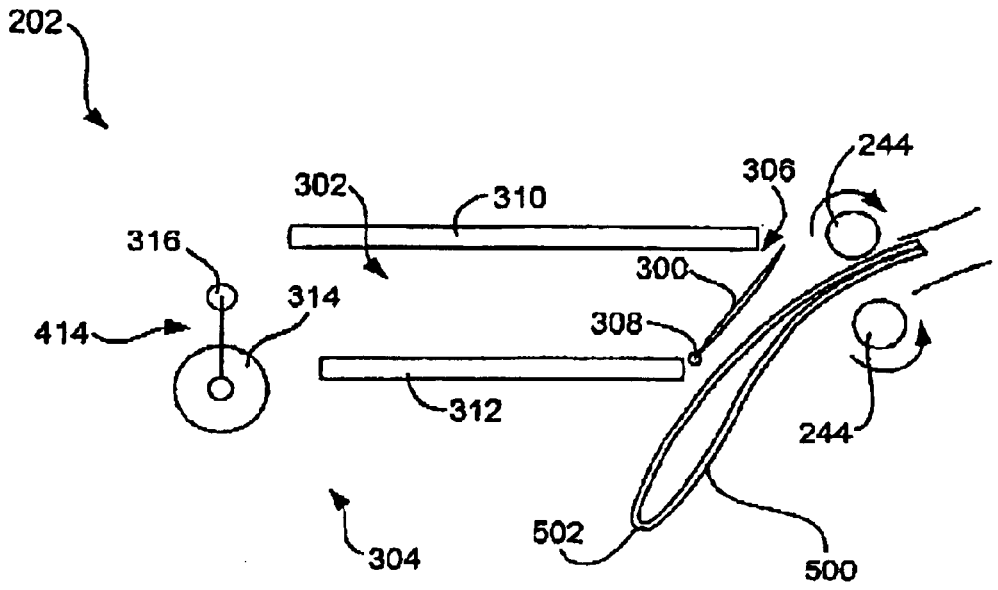
FIG. 5 is schematic view of the booklet stacking mechanism of FIG. 3 operating in a first mode.

The general construction of an example booklet stacking mechanism 202 having been described above, the operation of the mechanism will now be discussed with reference to FIGS. 5 and 6A–6D. FIG. 5 illustrates a first mode of operation of the booklet stacking mechanism 202. In this mode, the gate 300 is in the closed position such that a booklet 500 (or other print media) that is output from the booklet making apparatus 201 with the output rollers 244, is directed down to the vertical stacker bin 248 (FIG. 2). In such an arrangement, the booklets 500 will be oriented with their stapled sides 502 facing away from the electrophotographic imaging device 200.

After one or more booklets 500 have been deposited in the stacker bin 248 in the manner described above in reference to FIG. 5, one or more booklets can be deposited in the stacker bin in an opposite orientation, i.e., with the stapled side 502 facing the electrophotographic imaging device 200. Accordingly, the booklet orientation can be staggered such that an even, high capacity stack of booklets is formed and toppling due to booklet pillowing is avoided. To arrange booklets in the staggered orientation, the booklets 500 are turned through 180 degrees such that they are inverted before being deposited in the stacker bin 248. This inversion is accomplished through use of the booklet stacking mechanism 202 while operating in the second mode.

Figure 6A:
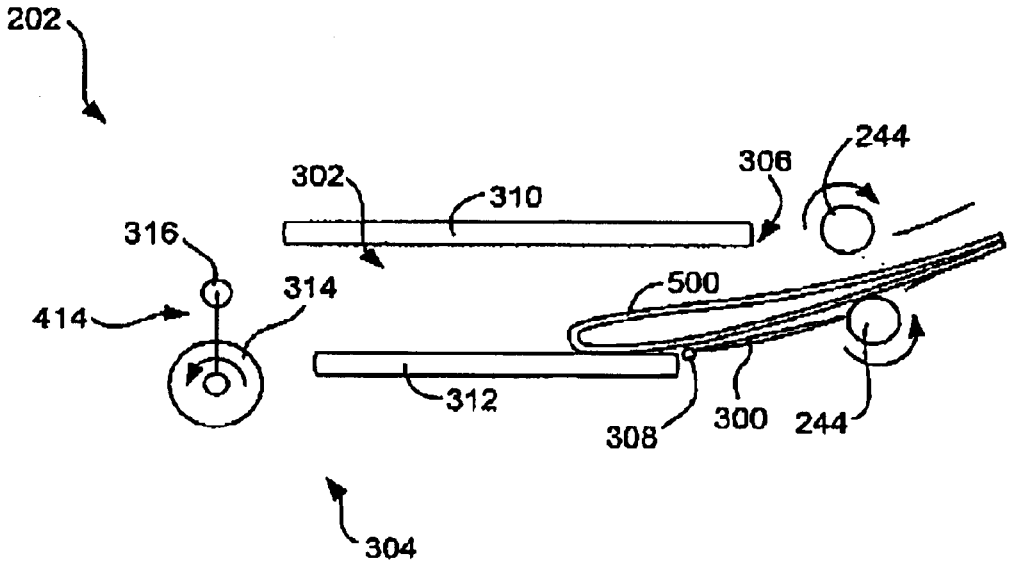
FIGS. 6A–6D are schematic views of the booklet stacking mechanism of FIG. 3 showing sequential stages of operation in a second mode.
Figure 6B:
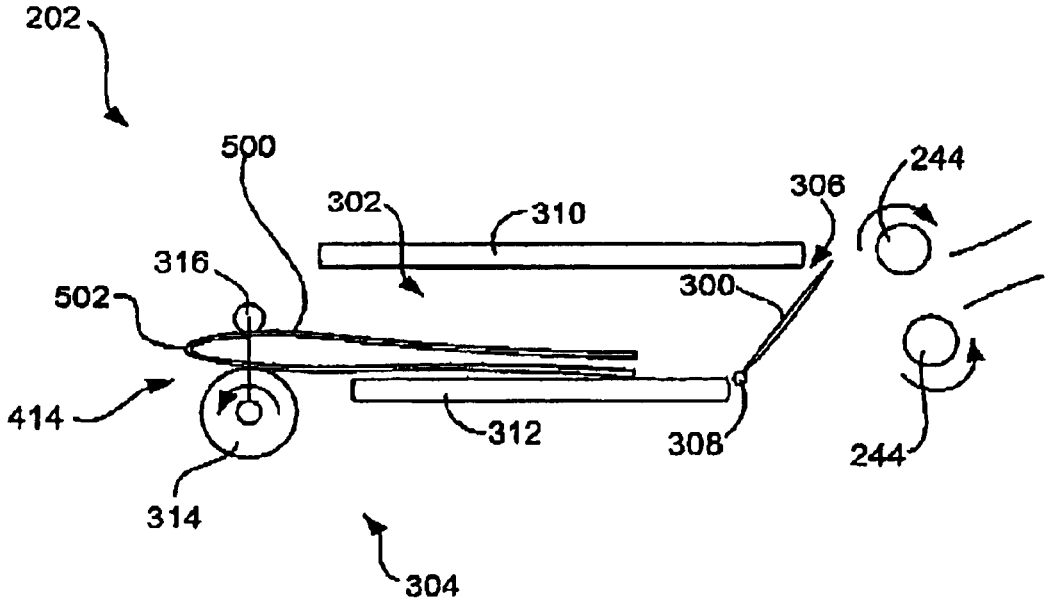

Referring now to FIGS. 6A–6D, the second mode of operation of the booklet stacking mechanism 202 will be described in sequential order. Beginning with FIG. 6A, the sequence starts with the gate 300 being pivoted about the shaft 308 such that the gate is placed in the open position. While the gate 300 is in this position, the booklet 500 cannot pass directly to the stacker bin 248 but instead, as indicated in FIG. 6A, is diverted into the delivery path 302 of the stacking mechanism 202. At this point, the main roller 314, if not already rotating, begins to rotate in the counterclockwise direction (in the orientation shown in FIGS. 6A–6D). The booklet 500 then travels along the delivery path 302 and into the nip 414 formed between the main roller 314 and the pressure rollers 316, as indicated in FIG. 6B.

Figure 6C:
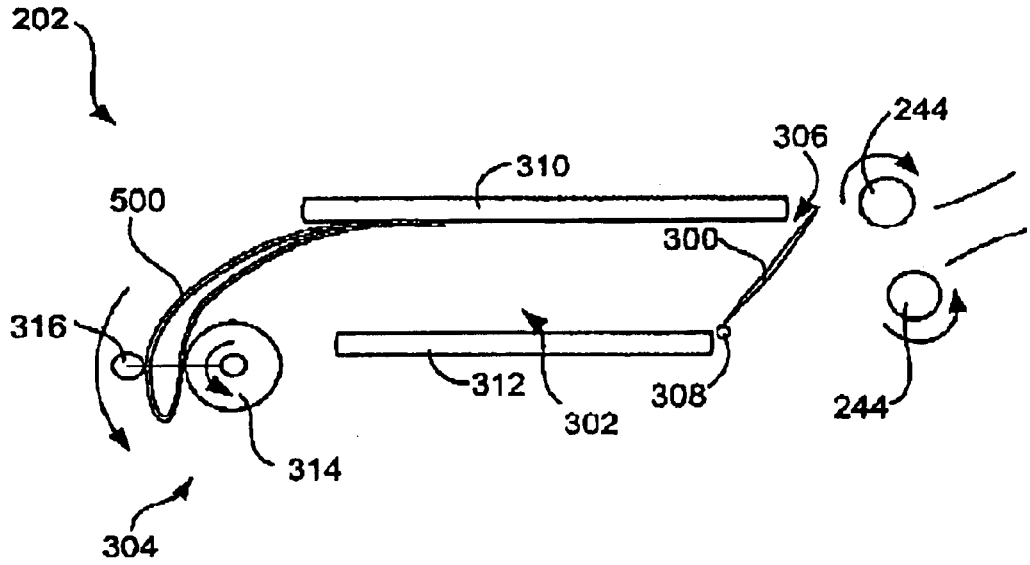

Once a predetermined portion of the booklet 500 has passed through the nip 414, e.g., an inch or two measuring from the stapled side 502, the clutch mechanism 408 (FIG. 4) engages. The degree of penetration of the booklet 500 through the nip 414 can be detected through use of a sensor (not shown), for example, a photodetector. Alternatively, the engagement of the clutch mechanism 408 can be timed based upon the completion of some event, e.g., the booklet 500 leaving the output rollers 244. In a further alternative, engagement can be activated in response to a predetermined amount of pressure being detected between the pressure rollers 316 and the main roller 314. In any case, once the clutch mechanism 408 engages, the collars 406, link members 410, support beam 412, and pressure rollers 316 rotate in unison with the main roller 314, as indicated in FIG. 6C, such that the booklet 500 is likewise rotated with the main roller and eventually turned upside down. The booklet 500 can be securely held between the main roller 314 and the pressure rollers 316 during this inversion due to the relative stiffness of the booklet adjacent its stapled side 502.

Figure 6D:
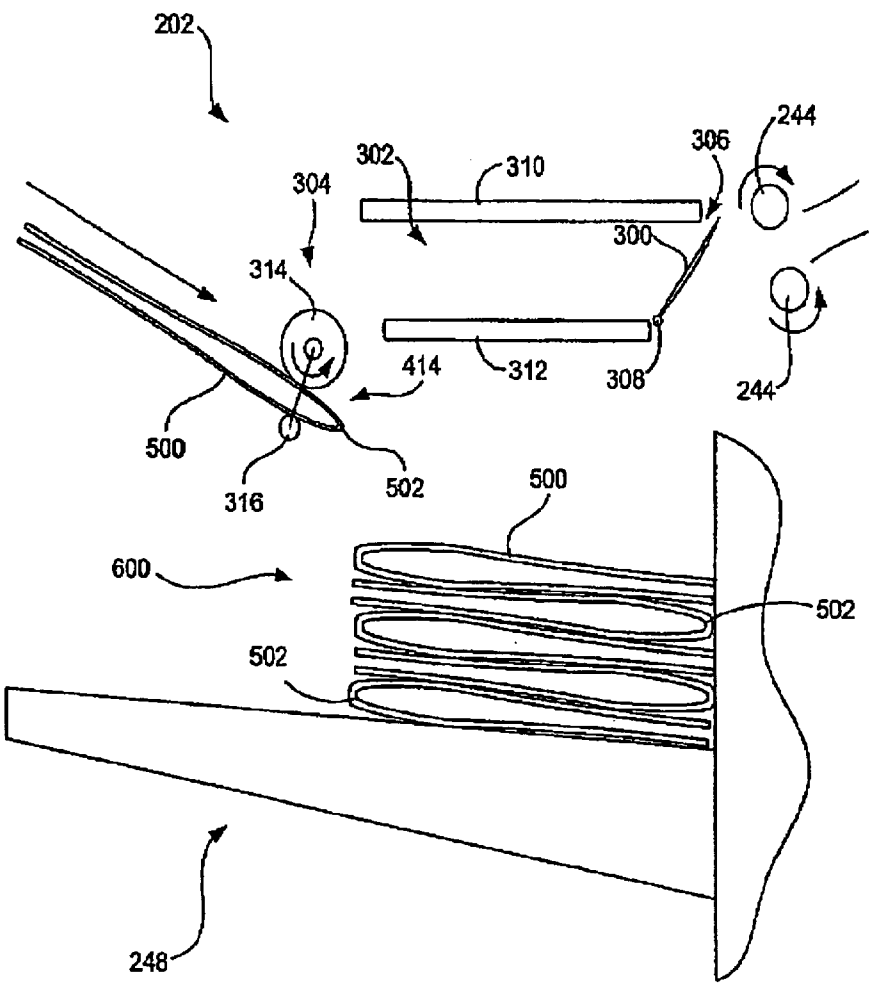

With reference now to FIG. 6D, once the pressure rollers 316 have traveled nearly through 180 degrees, the clutch mechanism 408 can be released such that revolution of the pressure rollers about the main roller 314 is interrupted. However, in that the main roller 314 is fixedly mounted to the drive shaft 404, it continues to rotate and the booklet 500 is driven to the stacker bin 248. As shown in FIG. 6D, the booklets 500 can, for instance, be deposited in the stacker bin 248 in a staggered vertical stack 600 such that the booklets vary in orientation between the stapled side 502 facing the printing device 200 and facing away from the device. By way of example, every other booklet 500 can be arranged such that the stapled side 502 is oriented away (or toward) the printing device 200. With this arrangement, the relatively thick portions of the booklets 500 adjacent the stapled sides 502 are alternated so as to achieve a balanced, high packing density stack 600 of booklets far superior to that obtainable with stack-slide trays. As will be appreciated by persons having ordinary skill in the art, such a stacking arrangement permits a larger number of booklets 500 to be deposited.

Figure 7:
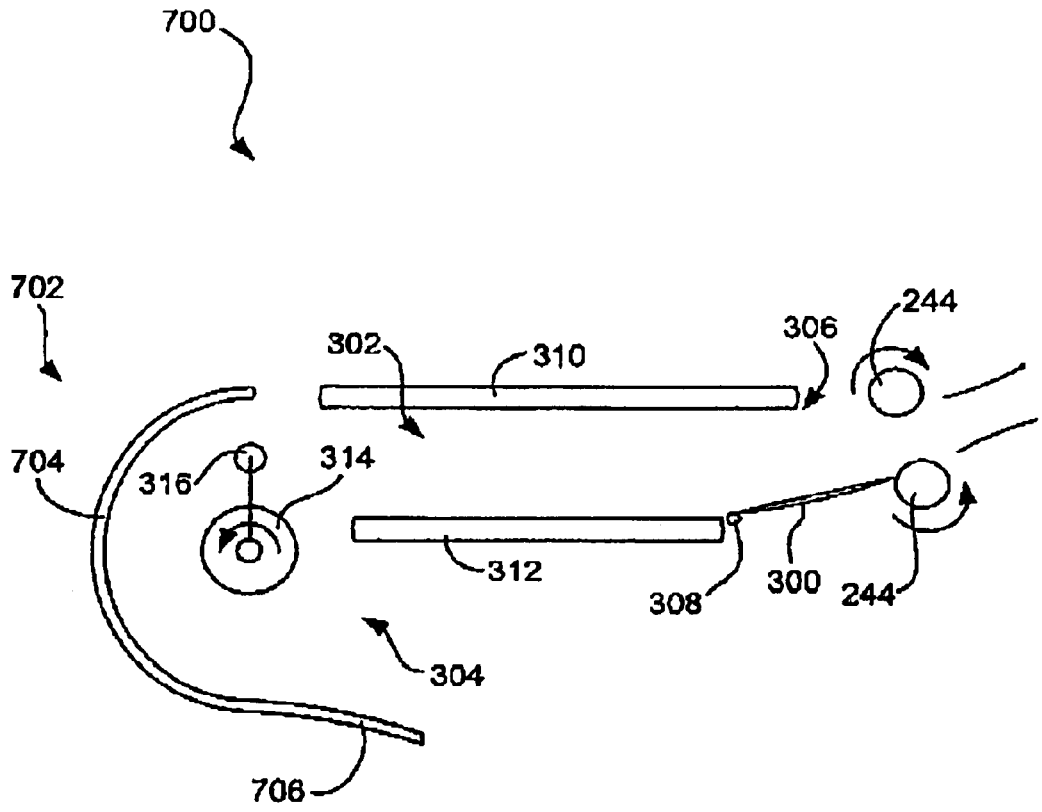
FIG. 7 is schematic view of an alternative booklet stacking mechanism.

FIG. 7 illustrates an alternative booklet stacking mechanism 700. As indicated in this figure, the booklet stacking mechanism 700 shares many of the same components discussed above with reference to the first embodiment shown in FIGS. 3–6. Accordingly, the booklet stacking mechanism 700 can include a gate 300, a delivery path 302, a flipping mechanism 304 including a main roller 314 and one or more pressure rollers 316, an opening 306 to the delivery path, a shaft 308 about which the gate can pivot, and upper and lower members 310 and 312 that define the delivery path. In addition, however, the booklet stacking mechanism shown in FIG. 7 further includes a guide 702 that is positioned proximate to the flipping mechanism 304.

As indicated in FIG. 7, the guide 702 is generally C-shaped when viewed from the side. More particularly, the guide 702 can, by way of example, comprise a substantially arcuate portion 704 and a substantially linear portion 706. The guide 702 is elongated (into the page) and typically has the same length of the flipping mechanism 304. With this configuration, the guide 702 can aid in the booklet flipping process conducted by the flipping mechanism 304 and further guide the booklet into the stacker bin 248. Specifically, the arcuate portion 704 can maintain a generally arcuate configuration of a booklet held by the flipping mechanism 304 as the booklet is inverted by the roller (see FIG. 6C) and the linear portion 706 can serve to guide the inverted booklet into the stacker bin 248.

Although the booklet stacking mechanism 700 shown in FIG. 7 is illustrated and described as including pressure rollers 316, it is to be appreciated that, depending upon the configuration of the guide 702 in relation to the flipping mechanism 304, the pressure rollers may not be necessary in that the main roller 314 in combination with the guide may be enough to properly invert the booklet and deliver it in the correct orientation to the stacker bin 248.

While particular embodiments of the invention have been disclosed in detail in the foregoing description and drawings for purposes of example, it will be understood by those skilled in the art that variations and modifications thereof can be made without departing from the scope of the invention as set forth in the following claims.

What is claimed is:

1. A booklet stacking mechanism, comprising:

a gate that is adapted to be placed adjacent an output area of a booklet making apparatus, the gate being positionable in a closed position and an open position;

a delivery path along which booklets can be delivered when the gate is in the open position; and a flipping mechanism that is adapted to receive booklets, invert them, and deposit them in a output bin, the mechanism comprising a main roller that is used to invert booklets.

2. The stacking mechanism of claim 1, wherein the gate is mounted to a shaft that is adapted to be driven by a drive mechanism.

3. The stacking mechanism of claim 1, wherein the flipping mechanism further comprises at least one pressure roller that, together with the main roller, forms a nip in which booklets can be received.

4. The stacking mechanism of claim 3, wherein the flipping mechanism further comprises a clutch mechanism that, when engaged, causes the at least one pressure roller to rotate in unison with the main roller.

5. The stacking mechanism of claim 1, wherein the flipping mechanism further comprises a guide that aids in inversion of booklets and their delivery to the output bin.

6. A booklet stacking mechanism, comprising:

a delivery path along which booklets can be delivered;

a gate positioned at an opening of the delivery path, the gate being positionable in a closed position in which booklets cannot enter the delivery path and an open position in which booklets can enter the delivery path; and a flipping mechanism positioned at an end of the delivery path that is adapted to invert booklets and deliver them to an output bin, the flipping mechanism comprising a main roller mounted to a first shaft, at least one pressure roller mounted to a second shaft, at least one link connected to the second shaft, and a clutch mechanism that is connected to the at least one link, the clutch mechanism being engageable to cause the at least one link, second shaft, and at least one pressure roller to rotate in unison with the main roller when the first shaft is driven.

7. The stacking mechanism of claim 6, wherein the gate is mounted to a shaft that is adapted to be driven by a drive mechanism.

8. The stacking mechanism of claim 6, wherein the flipping mechanism further comprises a guide that aids in inversion of booklets and their delivery to the output bin.

9. A printing device, comprising:

means for attracting toner to a surface of a print medium;

a booklet making apparatus;

a vertical stacker bin; and a booklet stacking mechanism that comprises a gate positioned adjacent an output area of the booklet making apparatus, the gate being positionable in a closed position and an open position, and a flipping mechanism that is adapted to receive booklets, invert them, and deposit them in the vertical stacker bin, the mechanism comprising a main roller that is used to invert booklets.

10. The device of claim 9, wherein the gate is mounted to a shaft that is driven by a drive mechanism from the closed position to the open position.

11. The device of claim 9, wherein the flipping mechanism further comprises at least one pressure roller that, together with the main roller, forms a nip in which booklets can be received.

12. The device of claim 11, wherein the flipping mechanism further comprises a clutch mechanism that, when engaged, causes the at least one pressure roller to rotate in unison with the main roller.

13. The device of claim 9, wherein the flipping mechanism further comprises a guide that aids in inversion of booklets and their delivery to the vertical stacker bin.

14. A method for stacking booklets, comprising the steps of:

permitting a booklet to be deposited in a vertical stacker bin;

preventing another booklet from being deposited in the vertical stacker bin and instead delivering the other booklet to a flipping mechanism with which the booklet is inverted by diverting the other booklet into a delivery path that leads to a flipping mechanism by opening a gate at an opening of the delivery path; and delivering the other booklet to the vertical stacker bin in the inverted orientation such that the booklets are arranged in a staggered configuration within the vertical stacker bin.

15. The method of claim 14, wherein the flipping mechanism comprises a main roller that inverts the other booklet.

16. The method of claim 15, wherein the flipping mechanism further comprises at least one pressure roller that, together with the main roller, forms a nip in which booklets can be received.

17. The method of claim 15, wherein the flipping mechanism further comprises a guide that aids in inverting the other booklet and delivering it to the vertical stacker bin.

* * * * *